US008479447B2

(12) United States Patent
Liebscher et al.

(10) Patent No.: US 8,479,447 B2
(45) Date of Patent: Jul. 9, 2013

(54) DRIVE SYSTEM FOR DRIVING AND FOR GUIDING A WALL ELEMENT FOR A ROOM PARTITIONING WALL SYSTEM

(75) Inventors: Arne Liebscher, Herdecke (DE); Olaf Lüttmann, Bad Zwischenahn (DE); Harald Hoopmann, Westerstede (DE)

(73) Assignee: Dorma GmbH +Co. KG, Ennepetal (DE)

( * ) Notice: Subject to any disclaimer, the term of this patent is extended or adjusted under 35 U.S.C. 154(b) by 177 days.

(21) Appl. No.: 13/000,285

(22) PCT Filed: May 29, 2009

(86) PCT No.: PCT/EP2009/003857

§ 371 (c)(1),
(2), (4) Date: Dec. 20, 2010

(87) PCT Pub. No.: WO2009/152943

PCT Pub. Date: Dec. 23, 2009

(65) Prior Publication Data

US 2011/0113693 A1 May 19, 2011

(30) Foreign Application Priority Data

Jun. 19, 2008 (DE) ..... 10 2008 028 831

(51) Int. Cl.
*E05F 15/14* (2006.01)
*E05F 11/54* (2006.01)

(52) U.S. Cl.
USPC ..... 49/360; 49/425; 49/409

(58) Field of Classification Search
USPC ..... 49/358, 425, 409, 410, 360
See application file for complete search history.

(56) References Cited

U.S. PATENT DOCUMENTS

| | | | | | |
|---|---|---|---|---|---|
| 3,938,282 | A * | 2/1976 | Goyal | 49/137 |
| 4,612,729 | A * | 9/1986 | Sato | 49/362 |
| 4,918,384 | A * | 4/1990 | Giringer et al. | 324/755.05 |
| 4,991,257 | A * | 2/1991 | Eutebach | 16/87 R |
| 5,090,171 | A * | 2/1992 | Kano et al. | 52/243.1 |
| 5,544,462 | A * | 8/1996 | Kordes | 52/243.1 |
| 5,606,826 | A * | 3/1997 | Calhoun | 49/138 |
| 5,852,897 | A * | 12/1998 | Sukale | 49/358 |
| 6,055,777 | A * | 5/2000 | Rekioja | 49/360 |
| 6,082,053 | A * | 7/2000 | Bischof et al. | 52/64 |
| 6,233,878 | B1 * | 5/2001 | Krahenbuhl et al. | 52/64 |
| 6,286,258 | B1 * | 9/2001 | Bischof et al. | 49/127 |
| 6,449,905 | B2 * | 9/2002 | Maki | 49/360 |
| 6,490,832 | B1 * | 12/2002 | Fischbach et al. | 52/207 |
| 6,799,393 | B2 * | 10/2004 | Stephen | 49/118 |

(Continued)

FOREIGN PATENT DOCUMENTS

| | | |
|---|---|---|
| DE | 199 32 891 | 1/2001 |
| EP | 0 597 208 | 5/1994 |

(Continued)

*Primary Examiner* — Katherine Mitchell
*Assistant Examiner* — Justin Rephann
(74) *Attorney, Agent, or Firm* — Cozen O'Connor

(57) ABSTRACT

A drive system for driving and for guiding a wall element, in particular for a room partitioning wall system, with a carriage unit, which is guided to be longitudinally movable in a guiding rail. The carriage unit has a roller carriage disposed within the guiding rail, and a drive unit disposed below the guiding rail. A guiding device is provided in the transition area between the roller carriage and the drive unit that cooperates with the guiding rail for guiding the carriage unit.

16 Claims, 5 Drawing Sheets

U.S. PATENT DOCUMENTS

| | | | | |
|---|---|---|---|---|
| 7,584,703 | B2 * | 9/2009 | Wallner | 104/106 |
| 7,712,258 | B2 * | 5/2010 | Ewing et al. | 49/410 |
| 2001/0011439 | A1 * | 8/2001 | Maki | 49/360 |
| 2002/0170234 | A1 * | 11/2002 | Salice | 49/453 |
| 2005/0172563 | A1 * | 8/2005 | Komoda | 49/358 |
| 2005/0235570 | A1 * | 10/2005 | Ginzel | 49/409 |
| 2006/0060010 | A1 * | 3/2006 | Haab et al. | 74/29 |
| 2006/0137564 | A1 * | 6/2006 | Wallner | 104/89 |
| 2006/0144529 | A1 | 7/2006 | Hemphill | |
| 2011/0120014 | A1 * | 5/2011 | Gerber et al. | 49/13 |
| 2011/0247275 | A1 * | 10/2011 | Coleman et al. | 49/358 |

FOREIGN PATENT DOCUMENTS

| | | |
|---|---|---|
| EP | 0 931 888 | 7/1999 |
| EP | 0 953 706 | 11/1999 |
| EP | 0 959 219 | 11/1999 |
| EP | 1 640 543 | 3/2006 |

* cited by examiner

DRIVE SYSTEM FOR DRIVING AND FOR GUIDING A WALL ELEMENT FOR A ROOM PARTITIONING WALL SYSTEM

PRIORITY CLAIM

This is a U.S. national stage of Application No. PCT/EP2009/003857, filed on May 29, 2009, which claims priority to German Application No: 10 2008 028 831.4, filed: Jun. 19, 2008, the contents of which are incorporated herein by reference.

BACKGROUND OF THE INVENTION

1. Field of the Invention

The present invention relates to a drive system for driving and guiding a wall element, in particular for a room partitioning wall system, with a carriage unit that is guided to be longitudinally movable in a guiding rail, wherein the carriage unit has a roller carriage disposed within the guiding rail, and a drive unit disposed below the guiding rail.

2. Related Art

Drive systems for driving and for guiding a wall element for room partitioning wall systems are well known. The drive systems have carriage units with respective drives such that the carriage units are autonomously displaceable in the guiding rail. For this purpose carriage units are known in different configurations, which mostly have a roller carriage located within the guiding rail, wherein a drive unit is affixed to said carriage, in which unit at least the drive motor, and optionally a transmission, is accommodated.

A drive system for driving and for guiding a wall element for a room partitioning wall system is known from EP 0 959 219 A2. A carriage unit is provided therein which is accommodated to be longitudinally movable in the guiding rail via rollers, wherein the rollers are driven via a drive unit. Guiding rollers are provided to allow for guiding the carriage unit within the guiding rail and in particular in branchings of several guiding rails, wherein said guiding rollers are guided on the upper side of the roller carriage of the carriage unit in pre-established guiding paths within the guiding rail. Complicated guiding geometries are required within the guiding rail for guiding, which complicate installing, un-installing and maintenance work considerably. As the guiding device is disposed on the upper side, it is necessary to dispose required current collectors and associated power rails laterally next to the displacement path of the carriage unit, which increases the structural dimensions of the drive system considerably.

A drive system of a carriage unit for a room partitioning wall system is known from DE 199 32 891 A1, which has several guiding rollers and requires further guiding devices within the guiding rail which cooperate with the guiding rollers. Also this structural configuration of the carriage unit, which is accommodated within the guiding rail to be longitudinally movable and serves to displace wall elements, requires considerable structural space such that the guiding rail needs to be considerably larger dimensioned. It is in particular desirable to minimize the height dimension of the drive system such that an improved basic structure of the drive system and in particular of the carriage unit is achieved.

SUMMARY OF THE INVENTION

Therefore it is an object of the present invention to provide a drive system for driving and for guiding a wall element for a room partitioning wall system which has an improved structure and allows for reduced dimensions.

This problem is solved based on a drive system with a carriage unit which is guided in a guiding rail to be longitudinally movable One embodiment of the invention includes the technical teaching that a guiding device is provided in the transition area between the roller carriage and the drive unit that cooperates with the guiding rail for guiding the carriage unit.

In this case, the invention is based on the idea that the basic structure of the carriage unit comprises three components, namely the roller carriage, which is accommodated and guided within the guiding rail, the guiding device and the drive unit. In this case, the guiding device is disposed between the roller carriage and the drive unit, wherein the cross-section of the guiding rail is configured in a C-shape and consequently forms a slot guidance in the C-opening, through which the guiding device extends and forms the connection between the inner roller carriage and the outer drive unit. The structural conception of the carriage unit allows to minimize the structural space, because the guiding device does not have to be incorporated within the box-shaped hollow space of the guiding rail.

Advantageously, the guiding device has at least one, and preferably two guiding rollers, which, for the purpose of guiding the carriage unit, roll on guiding surfaces laterally adjoin the guiding device. If the guiding device has two guiding rollers, the roller carriage is guided in the longitudinal direction of the guiding rail. If the guiding rail has a curvature or if the carriage unit passes through a branching, the roller carriage is able to follow the path of the guiding rail, because it is guided by two guiding rollers. The guiding rollers roll on the guiding surfaces are configured at the guiding rail and located in the lower area. The guiding rail forms a box-shaped hollow profile with a C-shaped cross-section and consequently with an opening on the underside, through which the guiding device extends. The carriage unit is rotatably disposed at the wall element, wherein the wall element may be guided by two carriage units in the guiding rail, one of said carriage units being driven. The second carriage unit simply serves for the purpose of guiding the wall element within the guiding rail without having a driving function. Therefore, the carriage units are rotatably disposed at the wall element such that the roller carriage can follow the curved path of the guiding rail. If the carriage unit passes a turnout a cooperating with the guiding device, is required so the displacement direction of the carriage unit corresponds to the desired direction. At the location of the turnout, the guiding rails may have flap elements for this purpose, which, like in a rail turnout, pre-determine the direction for the carriage unit to follow.

Another configuration of the carriage unit has an intermediate web that extends between the roller carriage and the drive unit. Thereby a mechanical connection can be created to connect the drive unit to the roller carriage. Furthermore, at least two connecting elements extend through the guiding device and the roller carriage, on which elements the guiding rollers are each rotatably accommodated. As an alternative, several intermediate webs may be provided, which likewise allow for the guiding rollers to be rotatably supported. The connecting elements however may likewise serve as a mechanical connection between the roller carriage and the drive unit. The roller carriage may comprise of an upper member and a lower member, wherein the intermediate web, as a part conformed to the lower member, extends in the direction of the drive unit. Preferably, the connecting elements are screwed in the upper member of the roller carriage via a thread, in order to join the upper member and the lower member of the roller carriage on top of each other, and in order to affix the drive unit to the roller carriage in addition to the rotatable reception of the guiding rollers.

According to another advantageous embodiment of the inventive drive system, the roller carriage has at least one current collector, which cooperates with at least one associated power rail incorporated in the guiding rail to transmit power, in order to feed a drive motor, which is accommodated in the drive unit and serves to displace the wall element in the guiding rail. The power rails are located on the inside in longitudinal direction within the guiding rail and are affixed to the upper side. If the roller carriage is displaced in longitudinal direction of the guiding rail, a permanent current contact can be maintained between the current collector and the power rail. The current collector serves for both, transmitting the power supply to the drive motor and for transmitting necessary control signals. The current collector is accommodated via guiding pins, wherein the guiding pins are guided within the connecting elements to be longitudinally movable. The guiding pins are brought into spring-loaded contact with the power rails by means of spring elements. The current collectors are double spring-loaded, in order to ensure a double contact between each current collector and an associated power rail. Consequently, the connecting elements assume several functions. One the one hand, they serve for mounting the upper member and the lower member of the roller carriage, by simultaneously achieving the connection between the roller carriage and the drive unit. On the other hand, the guiding rollers of the guiding device can be rotatably accommodated on the connecting elements via roller bearings. In addition to these functions, the current collector is simultaneously accommodated in the roller carriage via the connecting elements such that the connecting elements act as the central structural elements of the inventive carriage unit.

Advantageously, the roller carriage has a first electrical unit, which forms at least one interface to the current collector. A second electrical unit is accommodated in the drive unit and forms at least one interface to the drive motor. Both the first and the second electrical units are configured in the shape of a respective electrical printed circuit board, wherein an electrical connection extends between the electrical units. The latter is affixed to the carriage unit via mounts, wherein a first mount is located at the roller carriage and a second mount is affixed to the drive unit. The electrical connection may be a cable or a cable strand which extends laterally with regard to the guiding rollers. If the carriage unit is displaced within the guiding rail, the electrical connection can not get in contact with the guiding rail, such as to exclude damage to the electrical connection.

The guiding rail is affixed to the ceiling of a room, wherein the drive motor extends in vertical direction on the underside of the guiding rail and, together with the second electrical unit, is accommodated in a sheet metal support. The direction of extension of the drive motor in vertical direction corresponds to the disposition of the axis of rotation of the motor shaft such that the latter is located within the guiding rail vertical to the direction of movement of the roller carriage. The drive motor essentially has a cylindrically shaped basic structure, around which the sheet metal support extends. However, the sheet metal support is configured to be bent in a U-shape and provided with a U-opening which is disposed to be vertically oriented to the bottom. In addition to the drive motor, furthermore the second electrical unit is disposed in the U-shaped sheet metal support adjacent to the drive motor and is affixed to the sheet metal support.

For driving the roller carriage, different driving concepts may be provided in order to drive the roller carriage, which is disposed above the guiding device by means of the drive motor, which is disposed below the guiding device. A first driving concept provides a drive shaft, which is passes through the intermediate web and extends from the drive motor into the roller carriage, wherein the roller carriage has at least one roller which is supported on at least one roller carriage shaft, which can be driven via a worm gear system between the drive shaft and the roller carriage shaft. A worm gear system forms a simple type of transmission, which comprises only one gearing stage. The toothing of the worm gear system may be designed in that, in the event the drive motor would not be energized, it is possible to manually move the wall elements and thus displacing the roller carriage within the guiding rail. The drive motor, which is vertically disposed and accommodated in the sheet metal support, may be disposed concentrically with regard to the drive shaft, and, the worm of the worm gear system is located directly on the motor shaft.

Another transmission concept between the drive motor and the roller carriage comprises a cylindrical gear system, wherein the drive motor is laterally offset with regard to the drive shaft. The proper drive motor may be attached to the housing of the cylindrical gear system, wherein the cylindrical gear system and the drive motor may likewise form one mechanical unit.

Advantageously, the cylindrical gear system represents the first gearing stage between the drive motor and the roller carriage, wherein an angular gear system is disposed between the drive shaft and the roller carriage shaft in order to form the second gearing stage. The angular gear system may be configured as crown toothing, as bevel gear toothing, or as another toothing, in order to transmit the rotational movement of the vertically extending drive shaft to the horizontally extending roller carriage shaft, which is disposed perpendicular to the displacement direction of the roller carriage within the guiding rail. Rollers are supported on the outside of the roller carriage shaft, at least one of said rollers being driven by the drive motor. Furthermore, the roller carriage may have a roller carriage shaft with two rollers, wherein one of the rollers is driven on one side of the roller carriage and the second roller, disposed on the opposite side, is supported to be freely moving. Two embodiments of the roller carriage are thus illustrated, wherein a first embodiment has two rollers on one roller carriage shaft, only one of said rollers being driven. The roller located on the opposite side is freely rotatable in this case. The second embodiment of the roller carriage has two roller carriage shafts, which respectively accommodate two rollers. In this case, two rollers are driven on one side of the roller carriage, whereas the other two rollers, located on the opposite side, are supported to be freely moving. This configuration prevents the roller carriage from following a straight-line motion if the guiding rail is curved. On account of unilaterally driven rollers, the roller carriage is able to follow a curvature in the guiding rail without the roller carriage experiencing jamming or canting in the guiding rail. As an alternative, all four rollers may be driven, wherein the roller carriage shaft has a differential in order to compensate for the difference of rotation speed of a roller, located on the inside of a curvature, compared to a roller located on the outside.

In the present case, a drive system with a carriage unit is achieved which, based on its basic structure consisting of a roller carriage, guiding device and drive unit, allows for a plurality of embodiments. In particular several gearing types for transmitting the drive of the drive motor to the roller carriage shaft should be mentioned. In addition to a worm gear and a cylindrical gear system, via which the drive motor is disposed in the sheet metal support, another gear concept may be provided in which the gear is disposed adjacent to the drive motor within the sheet metal support. The transmission of the rotational movement between the drive motor and the gear may be realized via a belt drive, which has a least a first and a second belt pulley.

With one roller carriage and one roller carriage shaft, the angular gear system within the roller carriage may comprise one gear worm and one worm wheel, wherein, with two roller carriage shafts, one worm gear drives one worm wheel, for example for the first roller carriage shaft, and the second roller carriage shaft is driven by an intermediate shaft. If a bevel gear toothing is provided between the drive shaft and the roller carriage shaft, the drive shaft may also drive two roller carriage shafts, in that one bevel wheel on the drive shaft drives a bevel wheel on a roller carriage shaft and the second roller carriage shaft is driven by an interconnected intermediate shaft.

BRIEF DESCRIPTION OF DRAWINGS

In the following, further measures enhancing the invention will be illustrated in detail in conjunction with the description of one preferred embodiment of the invention based on the Figures, in which.

DETAILED DESCRIPTION OF THE DRAWINGS

Figure 1:
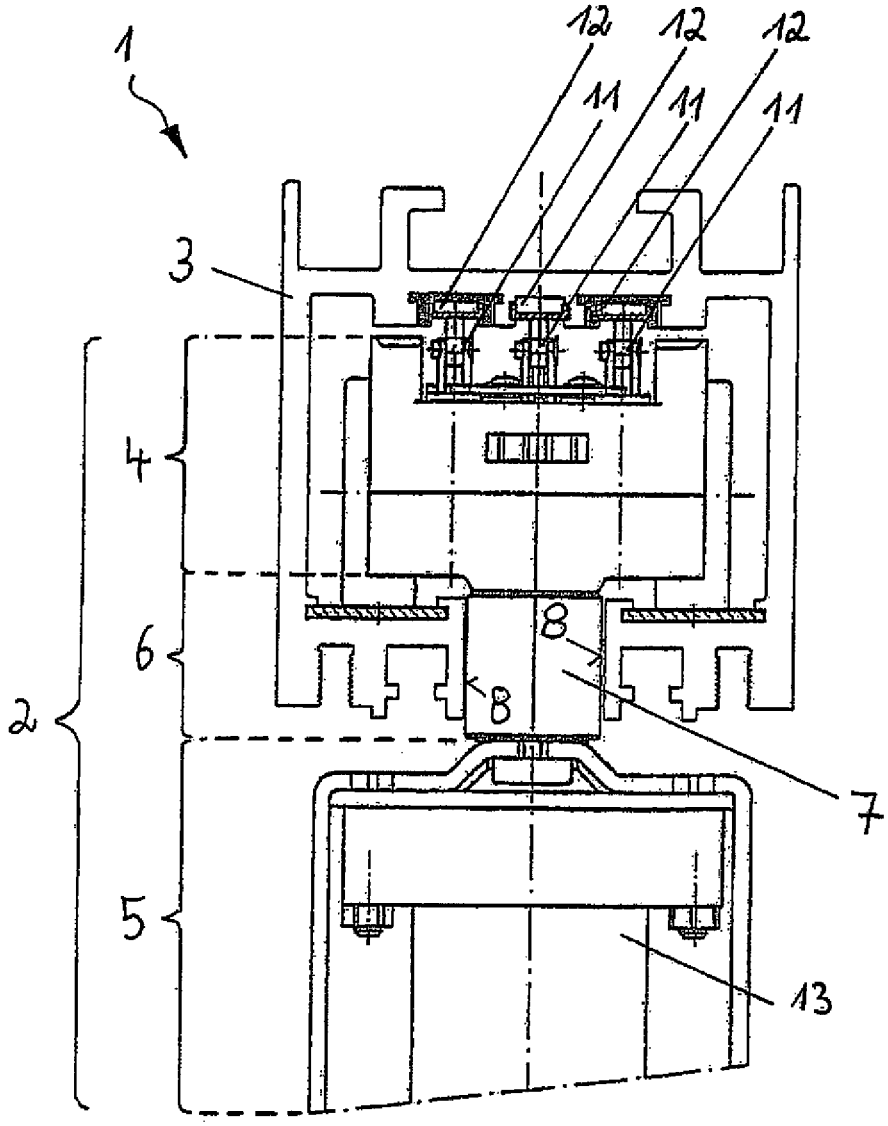
FIG. 1: is a drive system for driving and for guiding a wall element by a carriage unit.

FIG. 1 is an embodiment of a drive system 1 according to the present invention. The drive system 1 serves for driving and for guiding a wall element, which is utilized in room partitioning wall systems and is not illustrated in detail in the Figure. The wall element may be mounted to a carriage unit 2, wherein the carriage unit 2 is guided to be longitudinally movable within a guiding rail 3. The direction of movement of the carriage unit 2 extends vertically to the paper plane of FIG. 1. According to one embodiment of the present invention, the carriage unit 2 is subdivided into a roller carriage 4, which is located in the box-shaped hollow space of the guiding rail 3. For driving the roller carriage 4, a drive unit 5, which comprises at least one drive motor 13, is provided on the underside of the guiding rail 3. A guiding device 6 is disposed between the roller carriage 4 and the drive unit 5, wherein the roller carriage 4, the guiding device 6 and the drive unit 5 are all indicated with regard to their respective vertical sections. Consequently, the guiding device 6 extends between the roller carriage 4 and the drive unit 5, wherein the mechanical connection between the roller carriage 4 and the drive unit 5 is simultaneously formed by the guiding device 6.

The guiding device 6 has at least one guiding roller 7, which is guided at both, the left side and the right side by means of guiding surfaces 8. These surfaces are configured at the guiding rail 3 and form a sort of a longitudinal slot, which extends in the running direction of the guiding rail 3. The guiding surfaces 8 are formed by the flanks of the longitudinal slot, the guiding roller 7 being able to roll on either the left side or the right side thereof. As a result, a carriage unit 2 is proposed, which has a space-saving and advantageous guiding device 6 utilizing at the same time an existing cross-sectional shape of a guiding rail 3 in that guiding surfaces 8 are affixed thereto.

On the upper side, the roller carriage 4 has current collectors 11 which are in contact with respective power rails 12. The power rails 12 are accommodated in the top side of the guiding rail 3 via insulators. When the carriage unit 2 is displaced within the guiding rail 3, a permanent current contact and/or signal contact is guaranteed between the carriage unit 2 and the stationarily inserted power rails 12.

Figure 2:
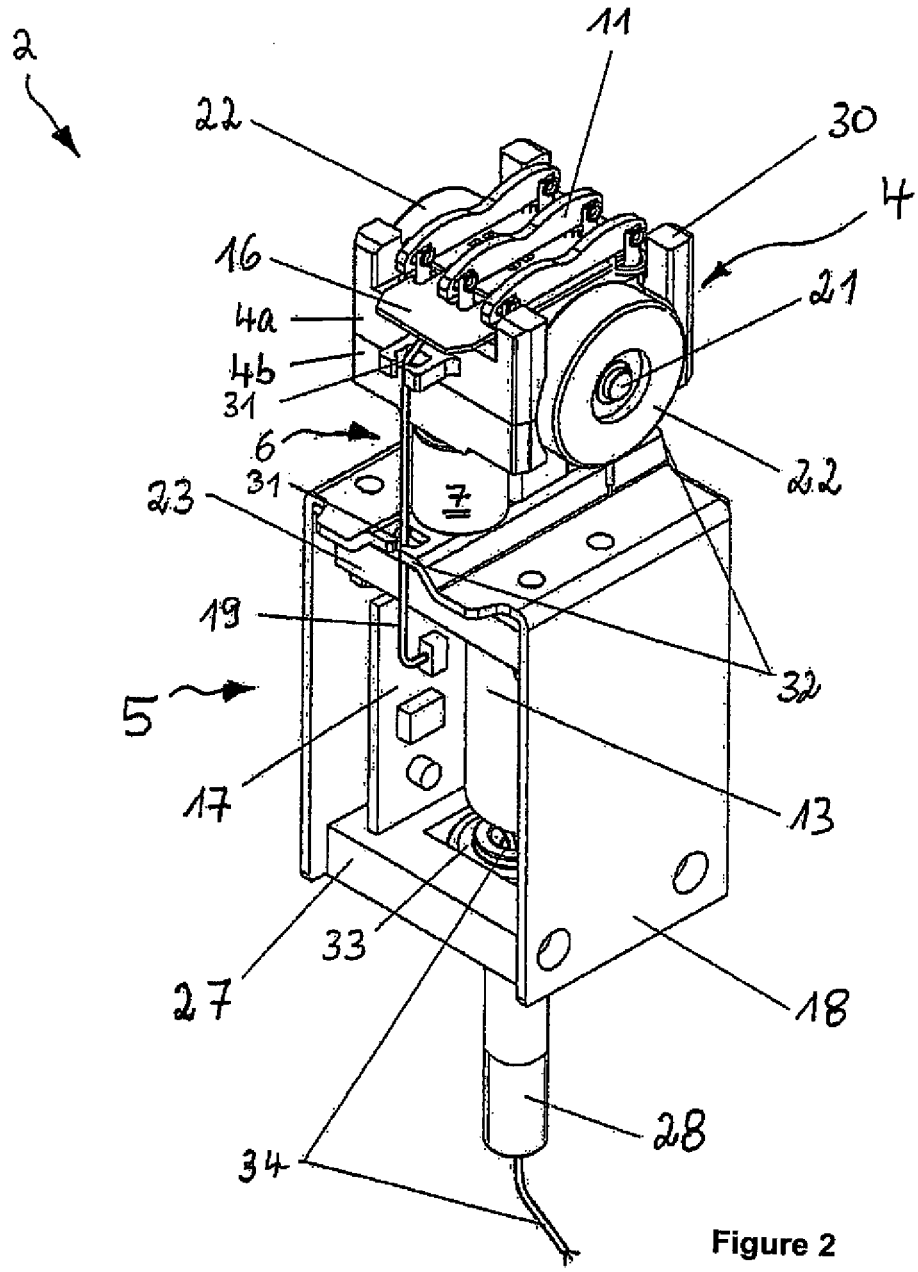
FIG. 2: is a perspective view of the carriage unit with a roller carriage, a drive unit and a guiding device disposed between the roller carriage and the drive unit.

FIG. 2 shows a perspective view of the inventive carriage unit 2 which is subdivided into the roller carriage 4, the guiding device 6 and the drive unit 5. The roller carriage 4 has an upper roller carriage member 4*a* and a lower roller carriage member 4*b*, wherein abutment surfaces 30 are provided at the upper roller carriage member 4*a* in order to limit canting or lifting of the carriage unit 2 within the guiding rail, in that the abutment surface 30 comes to abut against the inner side of the guiding rail.

The roller carriage 4 has one roller carriage shaft 21, wherein according to the illustrated embodiment, two rollers 22 are rotatably accommodated on the roller carriage shaft 21. In this case, one of the two rollers 22 can be driven by a drive motor 13, wherein the drive is realized via a gear, for example a cylindrical gear system 23, and both the drive motor 13 and the gear are accommodated in the drive unit 5.

Three current collectors 11 can be seen in the roller carriage 4 which are provided for power-transmitting contact with power rails which are installed in the guiding rail.

Essentially the drive unit 5 consists of a sheet metal support 18 in which the drive motor 13 and a second electrical unit 17 are accommodated. An electrical connection 19, which is affixed to both the roller carriage 4 and the sheet metal support 18 at the carriage unit 2 via attachment points 31, extends between the first electrical unit 16 on the roller carriage 4 and the second electrical unit 17 within the drive unit 5.

In lateral direction, which corresponds to the displacement direction of the carriage unit 2, the sheet metal support 18 is executed with mechanical abutments 32, which form a respective projection in the displacement direction. The sheet metal support 18 is bent in a U-shape with the U-opening being disposed to be vertically oriented to the bottom. A carrying element 27, at which a carrying bolt 28 is rotatably accommodated via a bearing assembly 33, is located in the U-opening of the sheet metal support. The carrying bolt 28 has a hollow bore in order to pass another electrical connection 34 through the carrying bolt 28 such that the connection extends between the drive unit 5 and the wall element, which is accommodated at the carrying bolt 28.

The drive motor 13 may be disposed concentrically with regard to the drive shaft 20. At least at one side of the sheet metal support 18, space is thus made available for the second electrical unit 17, which might be configured in the shape of a printed circuit board, to be disposed laterally at a sheet metal support 18 within the drive unit 5. In the event of maintenance work, this circumstance offers the advantage of being able to service the second electrical unit 17, the drive motor 13 and the gear 23, 24, 39, 40 and to exchange them if required, without having to uninstall the roller carriage 4 which runs in the guiding rail. The second electrical unit 17 serves at least for controlling the drive motor 13, wherein another electrical connection 34 is passed through a cable conduit 38, which is located within the carrying bolt 28. Thereby another connection can be realized between the carriage unit 2 and a wall element.

Figure 3:
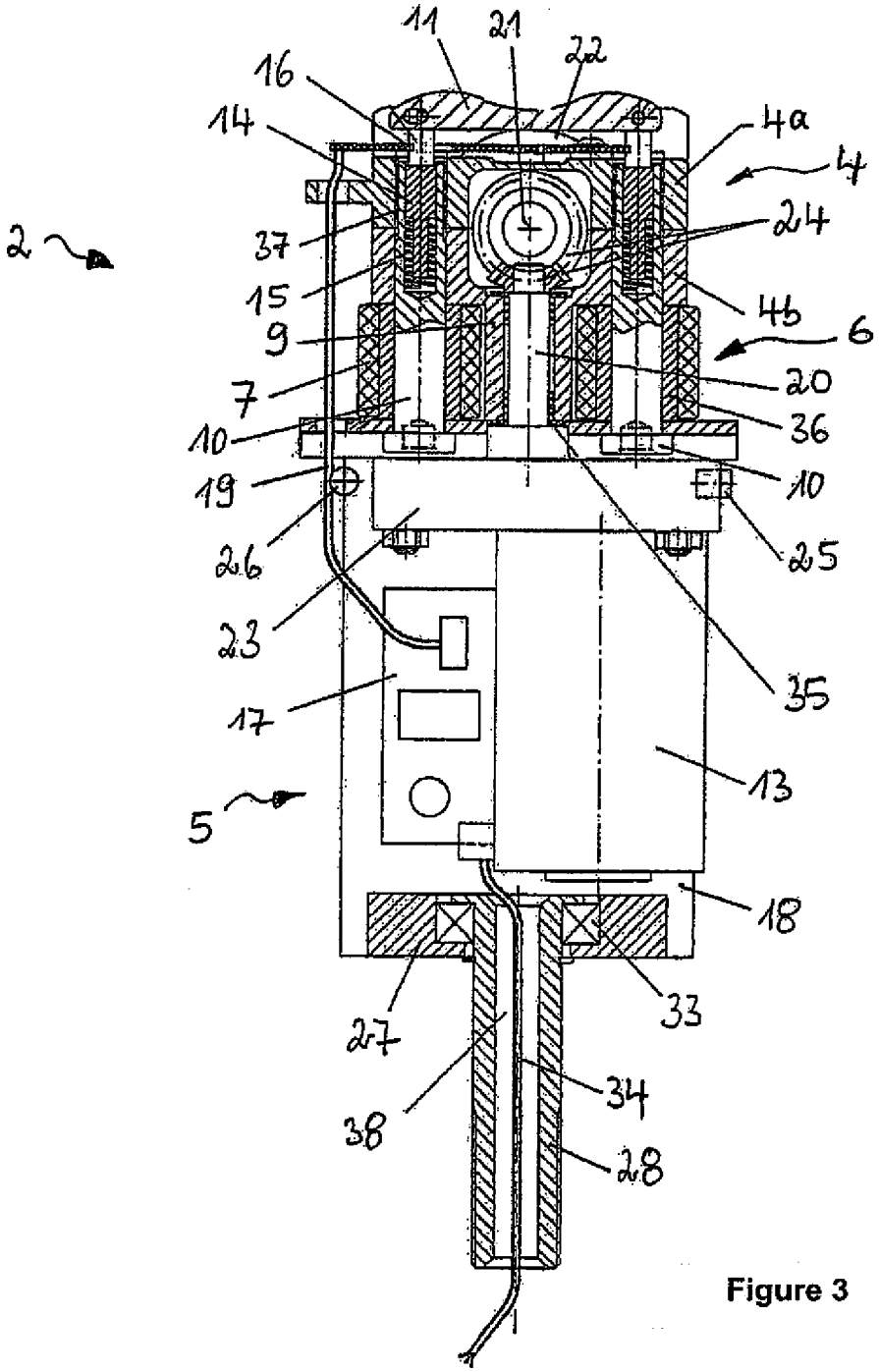
FIG. 3: is a sectional view of the carriage unit, wherein a cylindrical gear system as well as an angular toothing are disposed between the drive motor and the roller carriage shaft.

FIG. 3 shows a lateral view of the carriage unit 2, wherein at least the roller carriage 4, the guiding device 6, the carrying element 27 as well as the carrying bolt 28 are illustrated in a sectional view. The sectional view allows to show the driving train, which extends between the drive motor 13 and the roller carriage shaft 21. The drive motor 13 is disposed at a cylindrical gear system 23 from which a drive shaft 20 extends vertically to the top into the roller carriage 4. An angular gear system 24 in the shape of a bevelled toothing or crown toothing is configured at the drive shaft 20 and the roller carriage shaft 21, such as to entrain the roller carriage shaft 21 and consequently the rollers 22 in a rotational movement by operating the drive motor 13. The drive shaft 20 is rotatably supported in the lower roller carriage member 4*b* by bearing bushings 35.

Two connecting elements 10, the shape thereof resembling screw elements, extend through the lower roller carriage member 4*b* and the upper roller carriage member 4*a*. The elements are screwed in from the direction of the drive unit 5, wherein the connecting elements 10 extend through the lower roller carriage member 4*b* and are screwed into the upper roller carriage member 4*a* via a respective thread 37. Distance sleeves 36, which are secured against the lower roller carriage member 4*b* by means of the connecting elements 10, are provided for supporting the guiding rollers 7. Consequently, the distance sleeves 36 act as roller bearings, because respectively one guiding roller 7 for guiding the carriage unit 2 is disposed in the guiding rail on the left hand side and on the right hand side of the drive shaft 20. The drive shaft 20 passes through an intermediate web 9, which is conformed to the centre below the lower roller carriage member 4*b*.

Furthermore, the connecting elements 10 serve to accommodate the current collectors 11 in a spring-loaded manner. These collectors are supported by two guiding pins 14, which are respectively accommodated in an associated connecting element 10. The guiding pins 14 are loaded by spring elements 15 such as to be able to press the current collectors 11 against the power rail, which is located above the current collectors 11. A first electrical unit 16, which forms an interface to the current collector 11, is provided on the roller carriage 4. A second electrical unit 17 is accommodated in the drive unit 5, wherein an electrical connection 19 extends between the two electrical units 16 and 17. The second electrical unit 17 serves at least for controlling the drive motor 13, wherein another electrical connection 34 passes through a cable conduit 38, which is located within the carrying bolt 28. Thereby another connection can be realized between the carriage unit 2 and a wall element. The carrying bolt 28, the carrying element 27, as well as the bearing arrangement 33 are diagrammatically illustrated in a sectional view such as to elucidate that the carrying bolt 28 is rotatably accommodated in the carrying element 27. The carrying element 27 is affixed to the sheet metal support 18 of the drive unit 5, wherein the sheet metal support 18 is only illustrated by the rear half.

Both a detecting element 25 and a pick-up element 26 are disposed at the drive unit 5. The detecting element 25 may be configured in the shape of a permanent magnet for example, wherein the pick-up element 26 may be a reed contact. If several wall elements are moved in the guiding rail, the detecting element 25 and the pick-up element 26 allow for a distance control. In this case, the pick-up element 26 cooperates with a detecting element 25 of another adjacent moving carriage unit 2. In this case, the pick-up element 26 is connected to the second electrical unit 17 such that the electrical drive motor 13 can be controlled depending on detecting another approaching carriage unit 2.

Figure 4B:
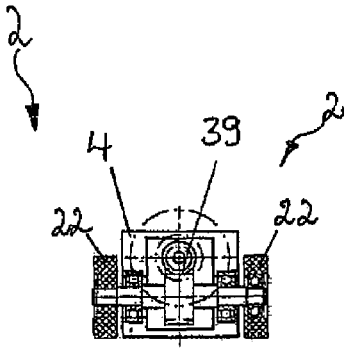
FIG. 4*b*: is a sectional view through the roller carriage according to FIG. 4*a*, in which the worm gear system is illustrated.
Figure 4A:
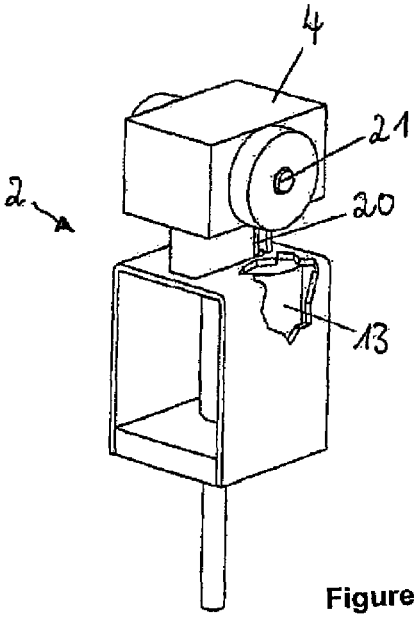
FIG. 4*a*: is a perspective view of a carriage unit with a worm gear system.

The FIGS. 4*a* and 4*b* represent another embodiment of a gear arrangement of the carriage unit 2. According to this embodiment, a worm gear system 39 is located between the drive motor 13 and the roller carriage shaft 21. In this case, the drive motor 13 may be disposed concentrically to the drive shaft 20 which extends through the guiding device 6, illustrated in a generalized manner, into the roller carriage 4. According to this embodiment, the roller carriage 4 comprises only one roller carriage shaft 21 with two rollers 22 accommodated thereon, only one of the rollers being driven.

Figure 5B:
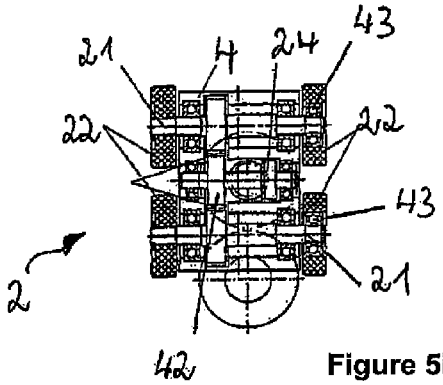
FIG. 5*b*: is a sectional view through a roller carriage of a carriage unit according to FIG. 5*a*, wherein two roller carriage shafts are provided which are driven by means of an angular gear system via an intermediate shaft.
Figure 5A:
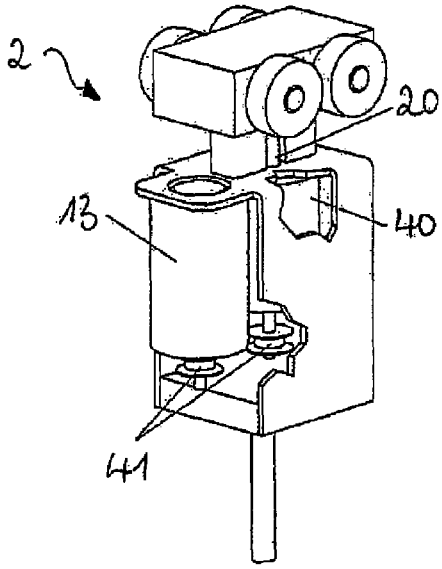
FIG. 5*a*: is a carriage unit with a drive motor and a gear, wherein the drive motor has a lateral offset with regard to the drive shaft.

The FIGS. 5*a* and 5*b* represent another embodiment of a carriage unit 2, wherein the drive motor 13 is disposed offset with regard to a planetary gear 40 located coaxially with regard to the drive shaft 20. In order to transmit the rotational movement of the drive shaft 20 of the drive motor 13 onto the planetary gear 40, belt pulleys 41 are provided, which are able to allow for either a synchronous speed or gearing-up or gearing-down between the drive motor 13 and the planetary gear 40. According to this embodiment, the roller carriage 4 has two roller carriage shafts 21 with respectively two rollers 22. The drive shaft 20 cooperates with an intermediate shaft 42, wherein, for converting the rotational movement, again an angular gear system 24 is disposed between the drive shaft 20 and the intermediate shaft 42. The rollers 22 illustrated on the left hand side in FIG. 5*b* are driven by the drive shaft 20, whereas the rollers 22 illustrated on the right hand side are freely rotatable via freewheeling bearings 43.

Figure 6B:
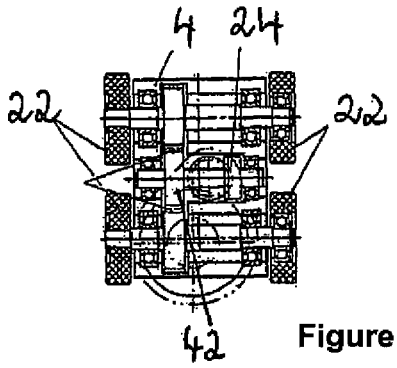
FIG. 6*b*: is a sectional view through a roller carriage of a carriage unit according to FIG. 6*a*, wherein two roller carriage shafts are provided which are driven by an angular gear system via an intermediate shaft.
Figure 6A:
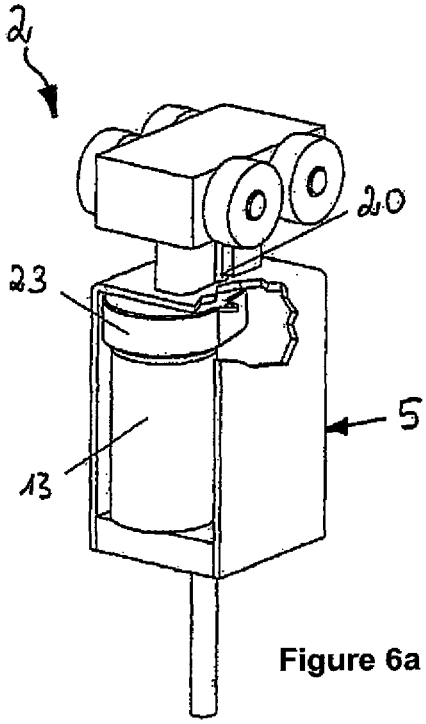
FIG. 6*a*: is a carriage unit with a cylindrical gear system, wherein the drive motor has a lateral offset with regard to the drive shaft.

FIGS. 6*a* and 6*b* show another embodiment of a carriage unit 2 wherein the drive motor 13 is accommodated in the drive unit 5, attached to a cylindrical gear system 23 and offset with regard to the drive shaft 20. FIG. 6*b* shows again an intermediate shaft 42 which is driven by the drive shaft 20 via an angular gear system 24 and allows for driving the two rollers 22 illustrated on the left hand side in the same way as described already in conjunction with FIG. 5*b*.

Figure 7B:
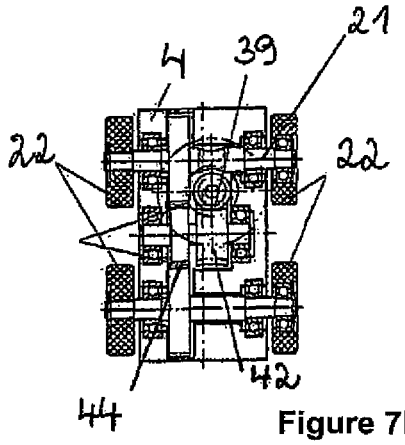
FIG. 7*b*: is a sectional view of the roller carriage of the carriage unit according to FIG. 7*a* with a drive shaft disposed off-centre that drives both a first roller carriage shaft and a second roller carriage shaft via an intermediate shaft.
Figure 7A:
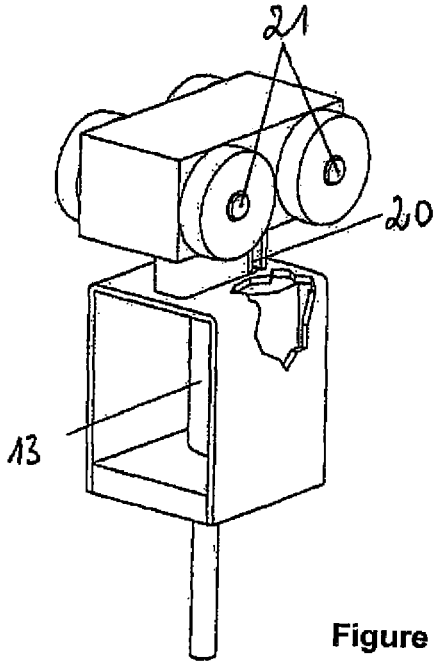
FIG. 7*a*: is a carriage unit with a drive motor which is disposed concentrically with regard to the drive shaft, wherein the drive shaft extends off-centre into the roller carriage.

FIGS. 7*a* and 7*b* show another embodiment of a gear arrangement between the drive motor 13 and the roller carriage shafts 21. Again a worm gear system 39 is proposed in this case, which cooperates with an intermediate shaft 42 in order to drive said shaft. The intermediate shaft 42 extends parallel between the two roller carriage shafts 21, wherein another cylindrical gear stage 44 is disposed between the intermediate shaft 42 and the roller carriage shafts 21.

The invention in its configuration is not limited to the above presented preferred embodiment. On the contrary, a number of variants are conceivable, which make use of the presented solution, even with basically different types of executions.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A drive system for driving and for guiding a wall element for a room partitioning wall system, comprising:

a guiding rail configured to be affixed to a ceiling of a room; and a carriage unit, which is guided to be longitudinally movable by the guiding rail, comprising:

a drive motor that extends in vertical direction on an underside of the guiding rail;

a roller carriage disposed within the guiding rail and having a first electrical unit that forms at least one interface to a current collector;

a drive unit disposed vertically below the guiding rail and having a second electrical unit that forms at least one interface to the drive motor;

a transition area between the roller carriage and the drive unit; and a guiding device provided in the transition area between the roller carriage and the drive unit that cooperates with the guiding rail for guiding the carriage unit;

a sheet metal support in which the drive motor and the second electrical unit are accommodated, wherein the second electrical unit is disposed adjacent to the drive motor and is attached to the sheet metal support; and a drive shaft disposed concentrically with respect to the vertically disposed drive motor.

2. The drive system according to claim 1, wherein the carriage unit comprises:

at least one distance measuring unit configured to detect a distance between a first and a second carriage unit comprising:

a detecting element; and a pick-up element.

3. The drive system according to claim 1, wherein the guiding device comprises at least one guiding roller configured to guide the carriage unit and roll on guiding surfaces that laterally adjoin the guiding device.

4. The drive system according to claim 3, further comprising an intermediate web that extends between the roller carriage and the drive unit to establish a mechanical connection, wherein the guiding device comprises at least two guiding rollers and the intermediate web is disposed between the at least two guiding rollers.

5. The drive system according to claim 4, wherein at least two connecting elements, on which the at least two guiding rollers are respectively rotatably accommodated, extend through the guiding device and the roller carriage.

6. The drive system according to claim 4, wherein the roller carriage comprises at least one current collector, which cooperates in a power-transmitting manner with at least one power rail incorporated into the guiding rail to feed a drive motor arranged in the drive unit, configured to displace the wall element in the guiding rail.

7. The drive system according to claim 6, wherein the current collector is oriented via guiding pins and is resiliently guided in the connecting elements with spring elements to provide a spring-loaded mechanical contact of the current collector with the power rail for collecting at least one of current and signals.

8. The drive system according to claim 4, wherein the first and the second electrical units are each configured as printed circuit boards, wherein an electrical connection extends between the first and the second electrical units.

9. The drive system according to claim 8, further comprising:

a drive shaft that extends from the drive motor into the roller carriage and passes through the intermediate web, wherein the roller carriage comprises at least one roller supported on at least one roller carriage shaft that is drivable via a worm gear system between the drive shaft and the roller carriage shaft.

10. The drive system according to claim 9, wherein the sheet metal support is configured in a U-shape and is disposed with the U-opening being oriented vertically downward, wherein a cylindrical gear system is disposed in the sheet metal support.

11. The drive system according to any of the claim 10, wherein a lateral offset is provided between the drive motor and the drive shaft, wherein the drive motor is mechanically connected to the cylindrical gear system.

12. The drive system according to claim 10, wherein the cylindrical gear system forms a first gearing stage, wherein an angular gear system is disposed between the drive shaft and the roller carriage shaft to form a second gearing stage.

13. The drive system according to claim 10, wherein a carrying element is accommodated in the U-opening of the sheet metal support, at which carrying element a carrying bolt is disposed for connecting the wall element to the carriage unit.

14. The drive system according to claim 13, wherein the carrying bolt has a cable conduit therethrough for guiding an additional electrical connection from the carriage unit in a direction of the wall element.

15. The drive system according to claim 9, wherein the roller carriage comprises:

a roller carriage shaft; and two rollers, wherein one of the rollers is driven on one side of the roller carriage and the second roller, disposed on an opposite side, is supported to rotate in a freewheeling manner.

16. The drive system according to claim 9, wherein the roller carriage comprises two roller carriage shafts each with two rollers, wherein two of the rollers on one side of the roller carriage are driven and the two rollers, disposed on an opposite side, are supported in a freewheeling manner.

* * * * *